US005391057A

United States Patent [19]

Bryce et al.

[11] Patent Number: 5,391,057

[45] Date of Patent: Feb. 21, 1995

[54] COMPRESSING GAS FLOWING THROUGH A CONDUIT

[75] Inventors: Stephen G. Bryce; Christopher Morley; Leslie C. Shirvill, all of Chester, United Kingdom

[73] Assignee: Shell Oil Company, Houston, Tex.

[21] Appl. No.: 49,692

[22] Filed: Apr. 19, 1993

[30] Foreign Application Priority Data

Apr. 22, 1992 [GB] United Kingdom ..... 92201141

[51] Int. Cl.[6] ..... F04F 1/16

[52] U.S. Cl. ..... 417/73; 137/13; 48/190

[58] Field of Search ..... 417/73; 48/190; 137/13

[56] References Cited

U.S. PATENT DOCUMENTS

| | | | |
|---|---|---|---|
| 355,116 | 12/1886 | Ash | 417/73 |
| 2,192,011 | 2/1940 | Koller . | |
| 2,398,654 | 4/1946 | Lubbock et al. . | |
| 2,550,515 | 4/1951 | Anderson | 417/73 |
| 2,614,387 | 10/1952 | Anderson | 417/73 |
| 2,636,445 | 4/1953 | Tutton . | |
| 2,719,080 | 9/1955 | Schmidt et al. . | |
| 2,860,484 | 11/1958 | Schmidt . | |
| 2,899,287 | 8/1959 | Paris . | |
| 3,108,737 | 10/1963 | King | 417/73 |
| 3,112,988 | 12/1963 | Coldren et al. . | |
| 3,257,180 | 6/1966 | King . | |
| 4,178,266 | 12/1979 | Burkert et al. . | |
| 4,192,655 | 3/1980 | von Linde . | |

FOREIGN PATENT DOCUMENTS

| | | | |
|---|---|---|---|
| 1011313 | 6/1952 | France . | |
| 2347129 | 3/1975 | Germany | 417/73 |
| 322066 | 5/1911 | Netherlands | 417/73 |

*Primary Examiner*—Richard A. Bertsch
*Assistant Examiner*—Roland G. McAndrews, Jr.

[57] ABSTRACT

An apparatus (1) is provided for compressing gas, the apparatus comprising a conduit (3) provided with a non-return inlet valve (10) arranged at the upstream inlet (5) end of the conduit (3), a localized ignition source (20) arranged in the conduit (3) downstream of the non-return inlet valve (10), and means (23) for intermittently supplying secondary fluid into the conduit (3) between the non-return inlet valve (10) and the localized ignition source (20).

1 Claim, 1 Drawing Sheet

COMPRESSING GAS FLOWING THROUGH A CONDUIT

FIELD OF THE INVENTION

The present invention relates to compressing gas flowing through a conduit. The gas can be an inert gas or an oxidant or a combustible gas such as natural gas.

BACKGROUND OF THE INVENTION

A suitable application of the present invention is downhole compression of natural gas; this is done to enhance the production from an underground natural gas reservoir. Natural gas is typically produced from an underground reservoir containing natural gas through tubing arranged in a well drilled to the reservoir. During production, the cumulative amount of natural gas produced increases and consequently the reservoir pressure will decrease. As a result of the decrease in reservoir pressure, the production rate decreases and, in order to maintain the production rate at an economically acceptable level the gas has to be compressed. The compression is preferably done downhole. This compression also results in an increased economic cumulative production.

An alternative application of the present invention is compression of a gas flowing through a pipeline to increase the rate of gas transported through the pipeline.

U.S. Pat. No. 2,899,287 discloses an apparatus for producing combustible gas from fuel oil or coal comprising a conduit provided with a non-return inlet valve arranged at the upstream inlet end of the conduit, a localized ignition source arranged in the conduit downstream of the non-return inlet valve, and means for supplying continuously fuel into the conduit between the non-return inlet valve and the localized ignition source.

The known apparatus is an apparatus for partially combusting fuel to generate a combustible gas. During normal operation (a) fuel is supplied continuously into the conduit with oxidant that has entered in the conduit through the non-return valve; (b) the combustible mixture is allowed to ignite, which ignition yields a high pressure wave front closing the non-return inlet valve and pushing gas out of the outlet end of the conduit and a low pressure wave front; and (c) the non-return inlet valve is allowed to open on arrival of the low pressure wave front to allow oxidant to enter into the conduit.

In the known method the interval between two successive combustions is determined by the geometry of the conduit which may not always have the most suitable form for an optimal interval. The pressure increase for the compression stage of the known apparatus is very small, the pressure at the outlet end of the conduit is about 2 or 3% above the pressure at the inlet end. For pumping natural gas such a pressure increase for a compression stage is unacceptably small. Therefore it is an object of the present invention to provide an apparatus for compressing a gas which will give a larger pressure increase than the known apparatus.

SUMMARY OF THE INVENTION

To this end, the apparatus for compressing gas according to the present invention comprises a conduit provided with a non-return inlet valve arranged at an upstream inlet end of the conduit, a localized ignition source arranged in the conduit downstream of the non-return inlet valve, and means for intermittently supplying secondary fluid into the conduit between the non-return inlet valve and the localized ignition source.

The invention further relates to a method of compressing gas flowing through a conduit having an inlet end and an outlet end and being provided with a non-return inlet valve at its inlet end, which method comprises the steps of (a) supplying intermittently a combustible mixture in the conduit downstream of the non-return inlet valve;

(b) allowing the combustible mixture to ignite, which ignition yields a high pressure wave front closing the non-return inlet valve and pushing gas out of the outlet end of the conduit and a low pressure wave front; and (c) allowing the non-return inlet valve to open on arrival of the low pressure wave front to allow gas to enter into the conduit.

Applicant has found that it is advantageous to supply intermittently a combustible mixture in the conduit, so that the interval between two successive combustions is determined by the interval between successive supplies of combustible mixture in the conduit. The geometry of the conduit can now be selected to minimize the resistance to flow.

By supplying intermittently a combustible mixture in the conduit the time-averaged amount of combustible mixture is small compared to the amount of gas flowing through the conduit.

DETAILED DESCRIPTION OF THE INVENTION

Figure 1:
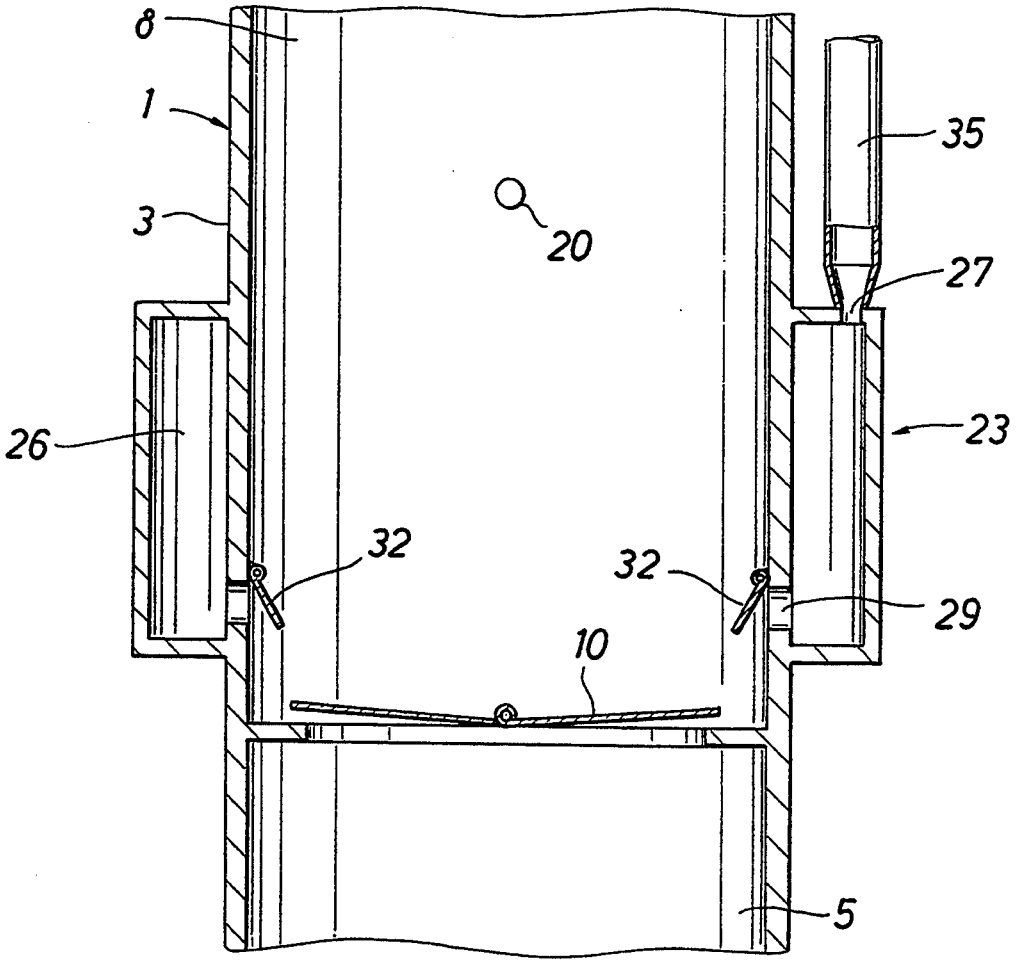
FIG. 1 is a schematic cross-sectional view of the apparatus for compressing gas according to the invention.

The apparatus 1 comprises a conduit 3 having an inlet end 5 and an outlet end 8, which conduit 3 is provided with a non-return inlet valve 10 arranged at the inlet end 5 of the conduit 3.

The conduit 3 is provided with a localized ignition source 20 arranged in the conduit 3 downstream of the non-return inlet valve 10, and with means 23 for intermittently supplying secondary fluid into the conduit 3 between the non-return inlet valve 10 and the localized ignition source 20.

The means 23 for intermittently supplying secondary fluid includes a container 26 having an inlet 27 and an outlet 29 debouching into the conduit 3 provided with a non-return outlet valve 32, and a supply conduit 35 which is connected to the inlet 27.

When the gas to be compressed is a combustible gas, corn pressing such a gas using the apparatus according to the present invention comprises allowing combustible gas to pass the non-return inlet valve 10 and supplying intermittently oxidant into the conduit through outlet 29 of the means 23 for intermittently supplying secondary fluid so that a combustible mixture is supplied intermittently in the conduit 3 downstream of the non-return inlet valve 10. The combustible mixture is allowed to ignite, which ignition yields a high pressure wave front closing the non-return inlet valve and pushing gas out of the outlet end of the conduit and a low pressure wave front. The non-return valve 10 is allowed to open on arrival of the low pressure wave front to allow combustible gas to enter into the conduit 3. A new cycle then starts.

The time-averaged amount of combustible gas required for the combustion is small compared to the amount of combustible gas flowing through the conduit 3.

This application is useful to compress natural gas for pumping the gas through a pipeline or through a well tubing arranged in a well extending from an underground gas reservoir to the surface.

The apparatus according to the invention can as well be used to compress oxidant, in which case the method comprises allowing oxidant to pass the non-return inlet valve 10 and the supplying intermittently fuel into the conduit through outlet 29 so that a combustible mixture is allowed to ignite, which ignition yields a high pressure wave front closing the non-return inlet valve and pushing gas out of the outlet end of the conduit and a low pressure wave front. The non-return valve 10 is allowed to open on arrival of the low pressure wave front to allow combustible gas to enter into the conduit 3. A new cycle then starts.

When the localized ignition source 20 is sufficiently heated, the localized ignition source acts as a hot spot so that supply of electric power can be interrupted.

The oxidant is a gas containing free oxygen, an example of suitable oxidant is air, a further example is air enriched with oxygen. The oxidant can furthermore contain water, which upon vaporizing will furthermore increase the pressure.

Each of the non-return inlet valve 10 and the non-return outlet valve 32 can be provided with a control device (not shown) allowing opening of the each of the valves 10 and 32 at a pre-determined pressure difference across the valve. By adjusting the control device the opening characteristics of the non-return valves can be adjusted. An example of such a control device is a spring, an other example of such control device is a magnetic latch.

The interval between two successive supplies of combustible mixture in the conduit is determined by the ratio of the diameter of the supply conduit 35 and the inlet 27 of the container 26, the volume of the container 26, and the opening characteristics of non-return outlet valve 32.

More than one apparatus according to the present invention can be arranged in series, each following apparatus compressing the gas compressed by the previous one. If required, the compressed gas can be cooled between two successive compressive stages.

The conduit 3 has a constant inner diameter; in an alternative embodiment of the invention, the conduit comprises, in the direction of flow, a narrowing section upstream of the non-return valve 10, a section having a constant diameter, and a widening section downstream of the localized ignition source 20.

We claim:

1. A method of compressing a combustible gas flowing through a conduit having an inlet end and an outlet end being provided with a non-return inlet valve at its inlet end, which method comprises the steps of:

(a) supplying intermittently a combustible mixture in the conduit downstream of the non-return valve by intermittently supplying an oxidant into the conduit downstream of the non-return inlet valve;

(b) allowing the combustible mixture to ignite, which ignition yields a high pressure wave front closing the non-return inlet valve and pushing gas out of the outlet end of the conduit and a low pressure wave front; and (c) allowing the non-return valve to open on arrival of the low pressure wave front to allow gas to enter into the conduit.

* * * * *